US007703610B2

(12) United States Patent
Matsuo et al.

(10) Patent No.: US 7,703,610 B2
(45) Date of Patent: Apr. 27, 2010

(54) METHOD FOR REMOVAL OF UNBURNED CARBON CONTAINED IN FLY ASH

(75) Inventors: Kazuyoshi Matsuo, Ichihara (JP); Kazuo Abe, Tokyo (JP); Takao Suzuki, Tokyo (JP); Shinichiro Saito, Kumagaya (JP)

(73) Assignees: Mitsui Engineering & Shipbuilding Co., Ltd., Tokyo (JP); Taiheiyo Cement Corporation, Tokyo (JP)

( * ) Notice: Subject to any disclaimer, the term of this patent is extended or adjusted under 35 U.S.C. 154(b) by 0 days.

(21) Appl. No.: 12/087,069

(22) PCT Filed: Dec. 11, 2006

(86) PCT No.: PCT/JP2006/324643

§ 371 (c)(1),
(2), (4) Date: Jun. 25, 2008

(87) PCT Pub. No.: WO2007/074627

PCT Pub. Date: Jul. 5, 2007

(65) Prior Publication Data

US 2009/0008302 A1 Jan. 8, 2009

(30) Foreign Application Priority Data

Dec. 26, 2005 (JP) ..... 2005-373020

(51) Int. Cl.
*B03D 1/02* (2006.01)

(52) U.S. Cl. ..... 209/164; 209/166

(58) Field of Classification Search ..... 209/166, 209/3, 164

See application file for complete search history.

(56) References Cited

U.S. PATENT DOCUMENTS

| | | | | |
|---|---|---|---|---|
| 4,268,379 A | | 5/1981 | Poulos et al. | 209/5 |
| 4,426,282 A | * | 1/1984 | Aunsholt | 209/167 |

FOREIGN PATENT DOCUMENTS

| | | | |
|---|---|---|---|
| JP | 54-089902 | A | 7/1979 |
| JP | 58-104652 | A | 6/1983 |
| JP | 59-127660 | A | 7/1984 |
| JP | 05-038468 | A | 2/1993 |
| JP | 08-057351 | A | 3/1996 |
| JP | 2003-266057 | A | 9/2003 |
| JP | 3613347 | B1 * | 1/2005 |
| JP | 2007-007485 | A | 1/2007 |

* cited by examiner

*Primary Examiner*—Thomas M Lithgow
(74) *Attorney, Agent, or Firm*—Kubovcik & Kubovcik

(57) ABSTRACT

Disclosed is a method for removal of an unburned carbon contained in a fly ash material. The method comprises the steps of adding water to the fly ash to prepare a fly ash slurry; shearing the fly ash slurry using an agitating blade that can rotate at a high speed to generate an active energy on the surface of an unburned carbon by the shearing force, thereby imparting lipophilicity to the unburned carbon; and adding a collecting agent and a foaming agent to the slurry containing the lipophylized unburned carbon to cause the attachment of the collecting agent to the lipophylized unburned carbon, and at the same time, causing the attachment of the unburned carbon having the collecting agent attached thereto an air bubble to separate the unburned carbon by flotation.

2 Claims, 5 Drawing Sheets

METHOD FOR REMOVAL OF UNBURNED CARBON CONTAINED IN FLY ASH

FIELD OF THE INVENTION

The present invention relates to a method of removing unburned carbon from fly ash, and in particular to a method of more efficiently removing unburned carbon from the fly ash which is generated in a coal fired power plant.

DESCRIPTION OF THE RELATED ART

Fly ash (FA) generated in a coal fired power plant has been used as a raw material for cement and artificial lightweight aggregate or cement admixtures.

However, because the unburned carbon contained in fly ash absorbs AE agent or water reducing agents, etc., when fly ash is used as a cement admixture, it is necessary to supply an extra amount of the AE agent or the water reducing agent, etc. after taking into consideration the absorption amount, and this is uneconomical. Furthermore, because unburned carbon has the water, repellency, it has a negative effect in that the unburned carbon separates from the concrete and floats to the top, and darker areas due to the unburned carbon are generated in the concrete-jointed portions. Also, in the case where large amounts of unburned carbon included in the fly ash are present, there is the problem that the quality of the artificial lightweight aggregate decreases because the bonding strength between the fly ash particles has decreased.

For this reason, only good quality fly ash with relatively small amounts of unburned carbon is used as a cement admixture, etc. and fly ash with a large amount of unburned carbon is used as a raw material for cement or is reclaimed as industrial waste.

However, because of a shortage of reclaimed land every year, a method for removing the unburned carbon from fly ash used as a raw material has been proposed. For example, in the specification of Japanese Patent No. 3613347, a method for removing the unburned carbon from fly ash is proposed in which flotation is performed by making the fly ash into a slurry by adding water; adding a collector such as kerosene to this slurry-state fly ash; stirring the slurry in which the collector was added with a high speed shear mixer; lipophilizing the surface of the unburned carbon included in the fly ash, and at the same time, attaching the unburned carbon of which the surface was lipophilized to the collector; generating air bubbles by adding a flother; and attaching the unburned carbon to the surface of the air bubbles through the collector.

However, because the flotation is performed in the conventional method of first adding the oil that is the collector (for example, kerosene) to the fly ash made into a slurry; stirring the slurry in which the collector was added with a high speed shear mixer; activating and lipophilizing the surface of the unburned carbon included in the fly ash, and at the same time, attaching the unburned carbon of which the surface was activated and lipophilized to the collector; furthermore, generating air bubbles by adding a foaming agent; and attaching the activated unburned carbon to the surface of the air bubbles through the collector, not only the part of the oil which is the collector attaches to the surface of the unburned carbon included in the fly ash, but also a part of the oil attaches to the surface of the activated ash content when it is stirred with a high speed shear mixer. For this reason, there is a problem in that the necessary amount of the oil which is the collector, to be added increases Furthermore, in the flotation step, because the ash content to which the oil content is attached also easily attaches to the air bubbles, a part of the ash content is also recovered as froth (unburned carbon) along with the unburned carbon. Therefore, the problem exists that the recovery rate of the ash content in the tail side decreases. Furthermore, because the oil of the collector does not attach selectively to the unburned carbon, the amount of collector becomes insufficient and there is a tendency for the amount of unburned carbon in the tail side to become high.

SUMMARY OF THE INVENTION

The present invention aims at solving such problems, and the objective is to provide a method for removing the unburned carbon in fly ash in which the recovery rate of the ash content is improved upon, the added amount of oil used as the collector is reduced, and the amount of unburned carbon in the tail side can be decreased when the unburned carbon in the fly ash is removed through using a flotation method which utilizes surface lipophilization (surface modification).

In order to solve the above-described problems, the present invention is constructed as follows.

The invention described in Claim 1 is a method of removing unburned carbon from fly ash of a raw material consisting of several steps: making the fly ash into a slurry by adding water; shearing the fly ash made into a slurry with a stirring blade rotating at high speed and adding lipophilicity by generating activation energy to the surface of the unburned carbon with the shearing force; and performing flotation by attaching the unburned carbon attached to the collector to the air bubbles together while attaching the collector to the lipophiliced unburned carbon by adding the collector and the flother to the slurry including the lipophiliced unburned carbon.

The invention includes a method for removing unburned carbon in fly ash as in Claim 1 in which the concentration of the fly ash in the slurry is 5 to 40 wt % when the fly ash is made into slurry by adding water.

The invention includes a method for removing unburned carbon in fly ash as in Claim 1 in which the stirring force is 10 to 100 $kWh/m^3$ per unit of slurry when the shear force is applied to the fly ash that is made into slurry.

The invention includes a method for removing unburned carbon in fly ash as in Claim 1 in which the residence time of the slurry is 0.1 to 10 minutes when the shear force is added to the fly ash that is made into slurry.

The invention includes a method for removing unburned carbon in fly ash as in Claim 1 in which the added amount of collector is 0 to 3.0 wt % to the fly ash when the collector is added to the slurry including the unburned carbon that has been lipophiliced by the activation energy.

The invention includes a method for removing unburned carbon in fly ash as in Claim 1 in which the added amount of flother is 20 to 5,000 ppm when the flother is added to the slurry including the unburned carbon that has been lipophiliced by the activation energy.

According to the present invention, because the fly ash is made into a slurry by adding water and then applying a shearing force to it using a high speed shear mixer for example, excessive activation energy (surface energy) is generated on the surface of the unburned carbon included in the fly ash and the surface is lipophiliced (hydrophobiced) at a higher rate.

Because the fly ash generated in a coal burning thermal electric power plant is generally combustion ash generated by combusting pulverized coal at high temperature (for example, 1200to 1500° C.), the surface of the unburned carbon included in it is in an oxidized state and the original lipophilicity is lost. However, the lipophilicity (hydrophobicity) can be recovered by applying a high shearing force during the slurry stage.

After that, when the collector and the flother are added to the slurry including the unburned carbon that has been lipophiliced by the activation energy, the surface of the lipophiliced unburned carbon is brought into close contact with the surface of particles in the collector (oil), and the surface energy decreases. On the one hand, the surface energy decreases as the surface of the activated fly ash adapts to water and disperses in water, and the hydrophilicity increases even more. As a result, the fly ash disperses into water and separates from the unburned carbon in the latter part of the flotation step. On the other hand, because air bubbles are generated by the flother, the unburned carbon separated from the fly ash attaches to the surface of the air bubbles and floats.

Therefore, according to the present invention, the collector is attached to the unburned carbon of which the surface is lipophiliced by activation by the surface modification. However, because the collector does not attach to the hydrophiliced fly ash, the added amount (the used amount) of the collector (oil) can be reduced compared to the amount in the conventional method. Furthermore, because there is no attachment of the collector to the surface of the fly ash, the recovery rate of the fly ash becomes high and the amount of the unburned carbon in the recovered fly ash becomes small.

DETAILED DESCRIPTION OF THE INVENTION

The embodiments of the present invention are explained using figures below.

Figure 1:
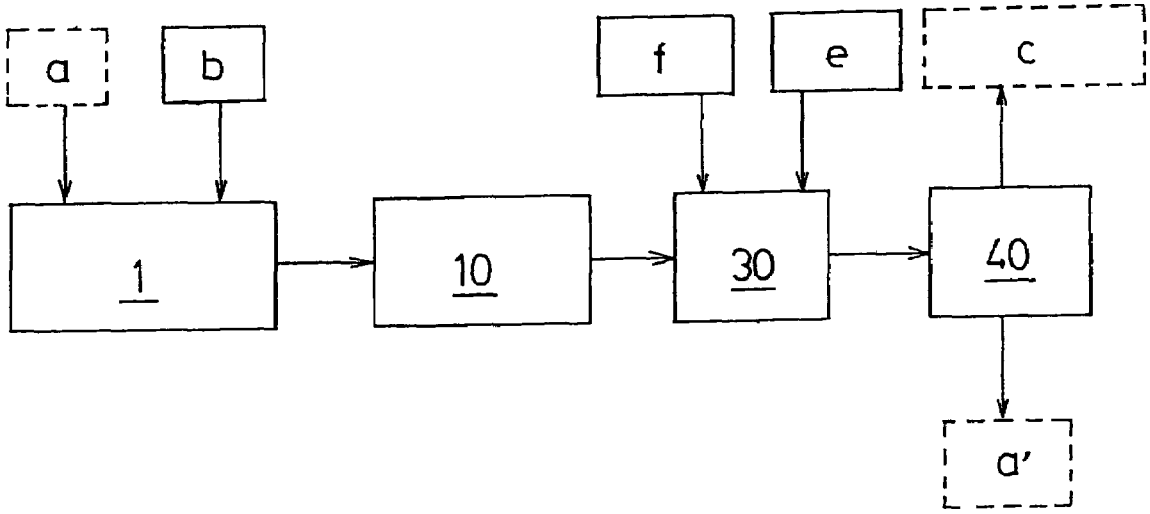
FIG. 1 shows a system block diagram to carry out the method for removing the unburned carbon in the fly ash in the present invention.

As shown in FIG. 1, the system to carry out the method for removing the unburned carbon in fly ash in the present invention is mainly configured with a slurry adjusting tank 1 in which fly ash a of a raw material is made into a slurry by adding water b, a surface upgrading machine (for example, a high speed shear mixer 10) performing surface upgrading of the fly ash made into a slurry, an adjusting tank 30 in which a collector e and a flother f are added to the slurry after surface upgrading, a flotation unit 40 in which the slurry after the collector and the flother are added is stirred and the unburned carbon is floated together with air bubbles, etc.

Figure 2:
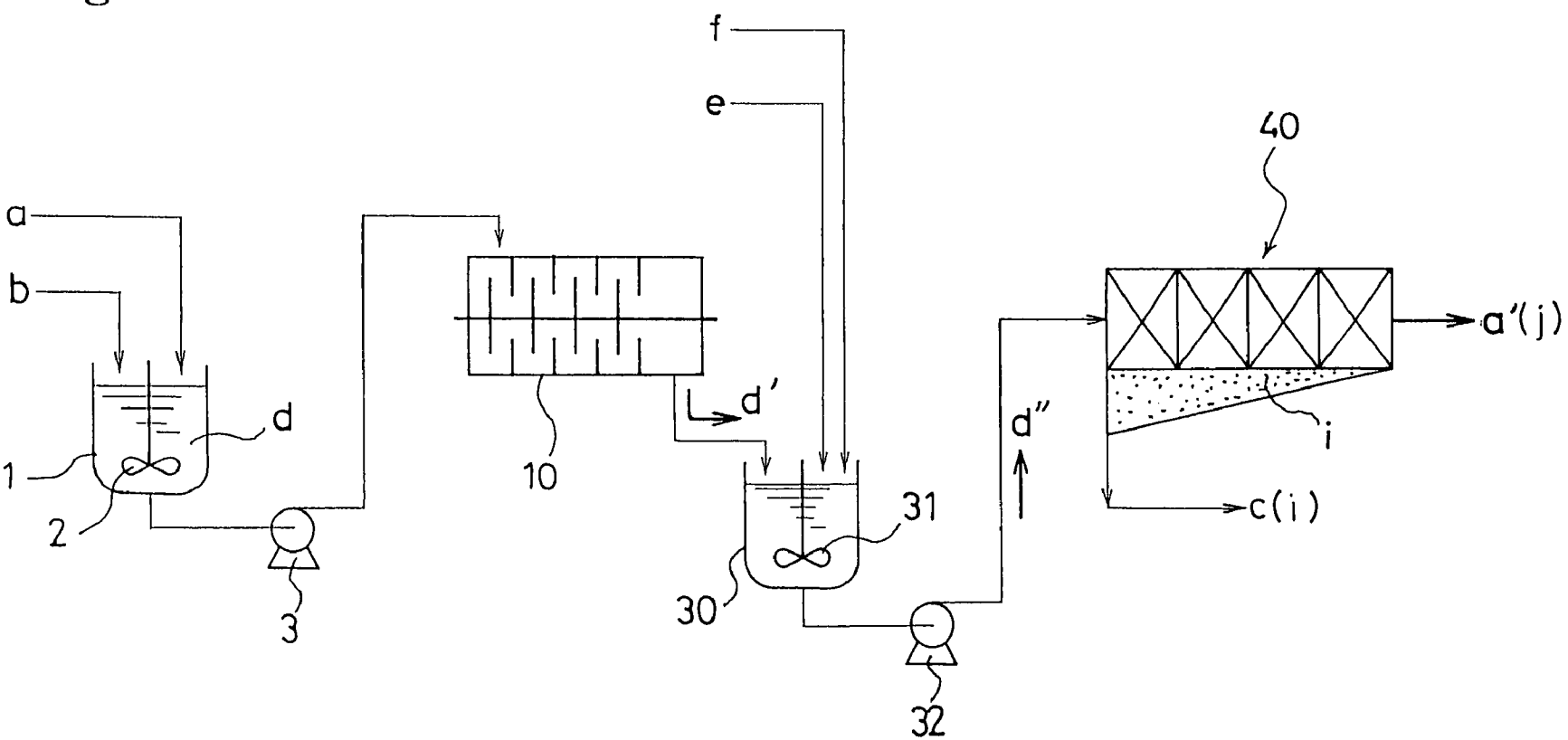
FIG. 2 shows a configuration diagram of an apparatus to carry out the method for removing the unburned carbon in the fly ash in the present invention.

As shown in FIG. 2, the slurry adjusting tank 1 is provided to produce a slurry d with the fly ash a and the water b and is equipped with a stirring blade 2 to stir the slurry d inside. The front part of this slurry adjusting tank 1 is provided with a fly ash tank and a water supplying facility, and the back part has a pump 3 to supply the slurry d to a high speed shear mixer 10 which is a surface upgrading apparatus.

Figure 3:
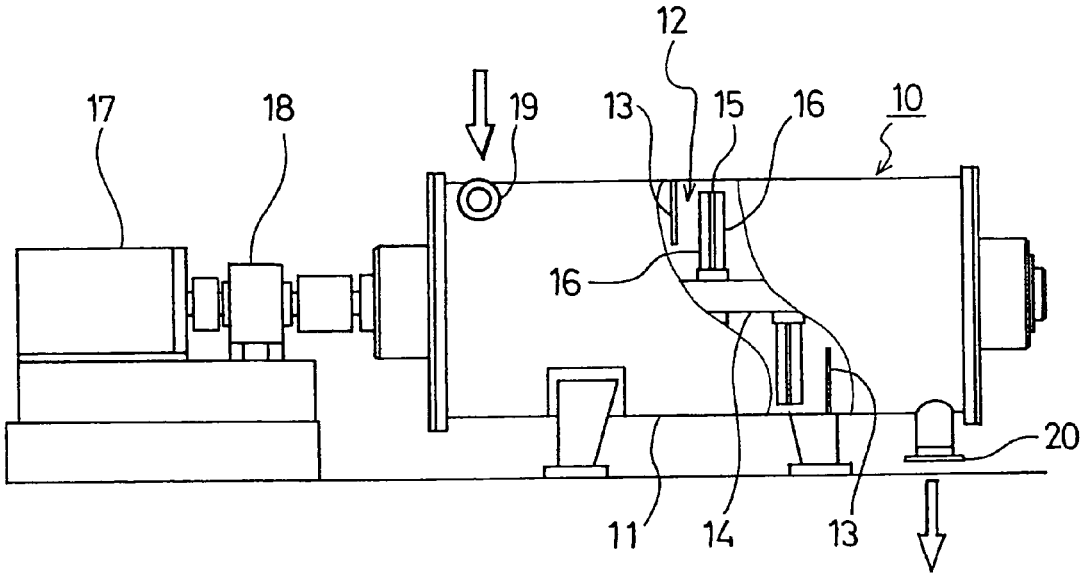
FIG. 3 shows a side view including a part of the cross-section of a high speed shear mixer.

The high speed shear mixer 10 is provided to modify the surface of the unburned carbon by adding a shearing force (grazing force) to the fly ash that is made into slurry. This high speed shear mixer 10 is, as shown in FIG. 3, equipped with a lateral type cylindrically-shaped main body 11, a plurality of annular partitioning walls 13 partitioning the main body 11 into a plurality of rooms 12 in its axial direction, a rotary shaft 14 passing through the main body 11, a disc 15 provided in the rotary shaft 14, and a plurality of stirring blades 16 provided radially on both sides of the disc 15, and the rotary shaft 14 and the stirring blades 16 are made to rotate by a motor 17 and a speed reducer 18.

In the adjusting tank 30, a small amount of the collector e such as kerosene, gas oil, and heavy oil and the flother f such as MIBC (methylisobutylcarbinol) is added to the slurry which is made from the high speed shear mixer 10 and mixed, and as shown in FIG. 2, the adjusting tank 30 is equipped with a stirring blade 31 for stirring at low speed inside. In the latter part of this adjusting tank 30, a pump 32 is arranged to supply the slurry d to the flotation unit 40.

Figure 4:
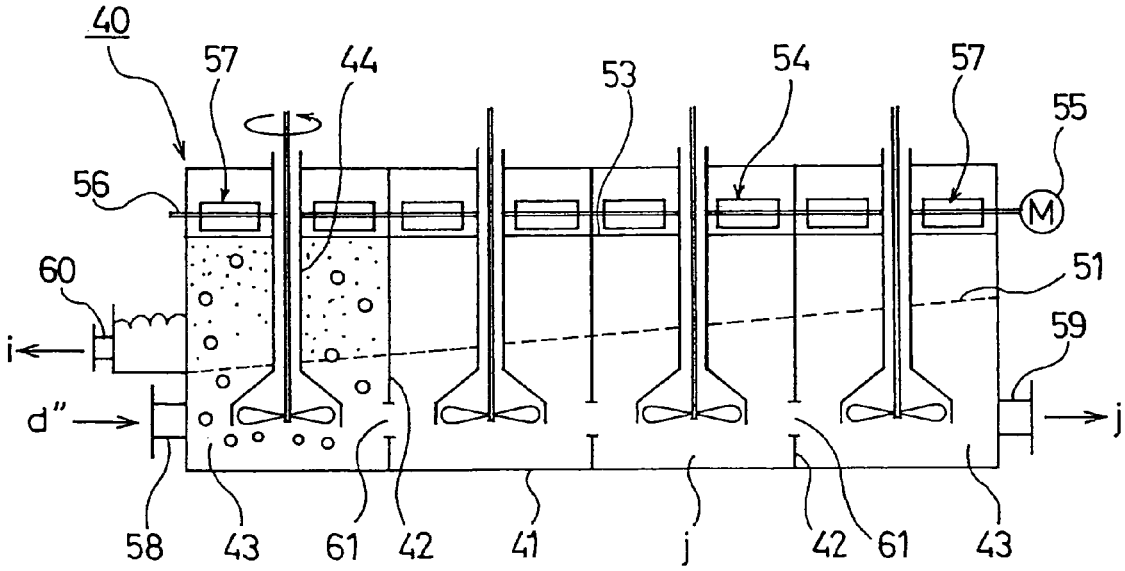
FIG. 4 shows a sectional view of one example of a flotation unit.
Figure 5:
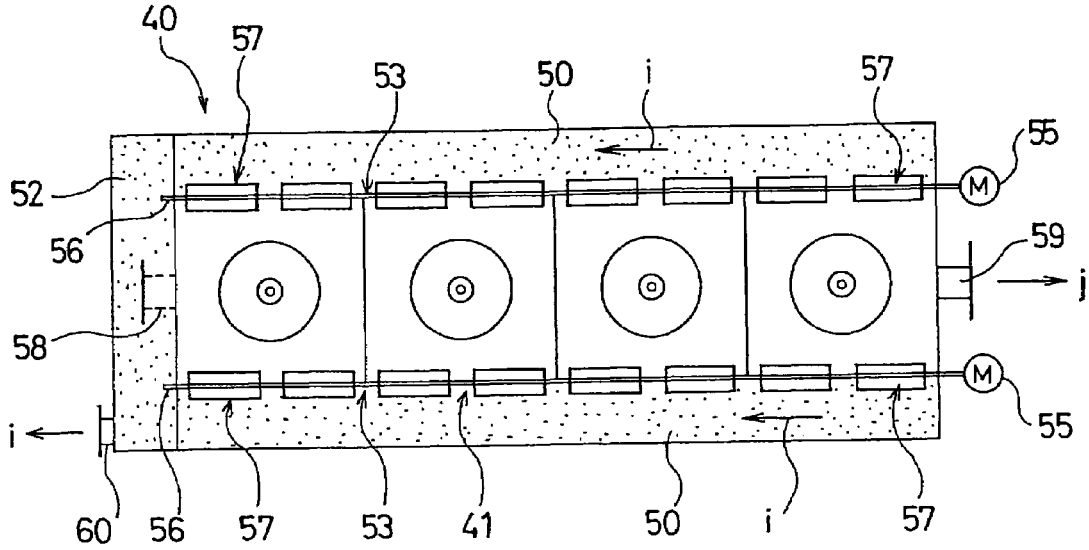
FIG. 5 shows a plan view of one example of a flotation unit.

In the flotation unit 40, the unburned carbon is floated by attaching to the generated air bubbles, and the slurry d is separated into unburned carbon c and an ash content in which the unburned carbon is removed a'. This flotation unit 40 has a structure shown in FIGS. 4 to 6, for example. However, other structures (for example, a column flotation) can be used.

Figure 6:
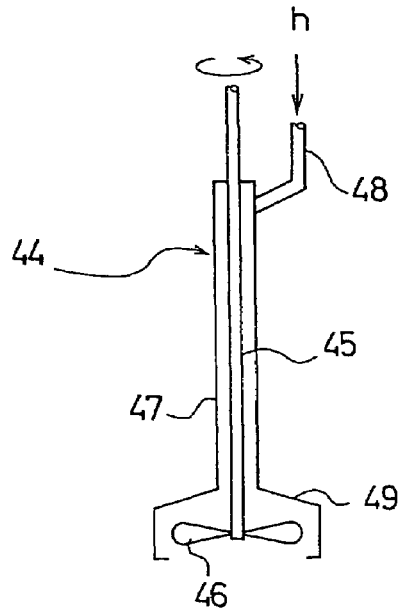
FIG. 6 shows a sectional view of one example of a stirring machine.
Figure 7A:
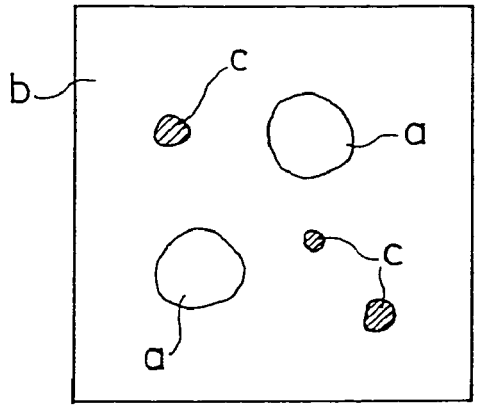
FIG. 7(*a*) is a state view showing when it is slurry, FIG. 7(*b*) is a state-view showing when surface upgrading is performed, FIG. 7(*c*) is a state view showing when the collector is added, and FIG. 7(*d*) is a state view showing when flotation is performed.
Figure 7B:
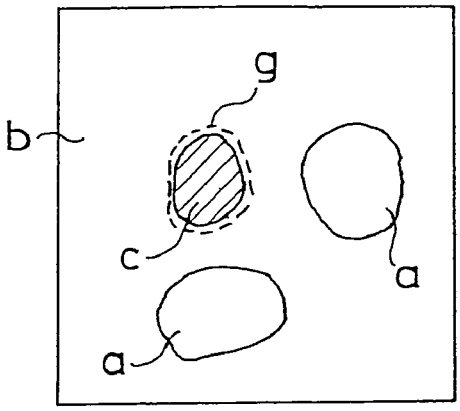
Figure 7C:
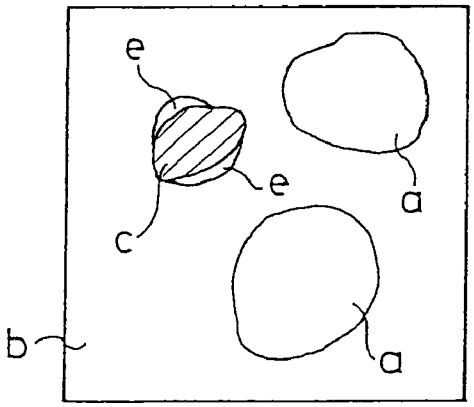
Figure 7D:
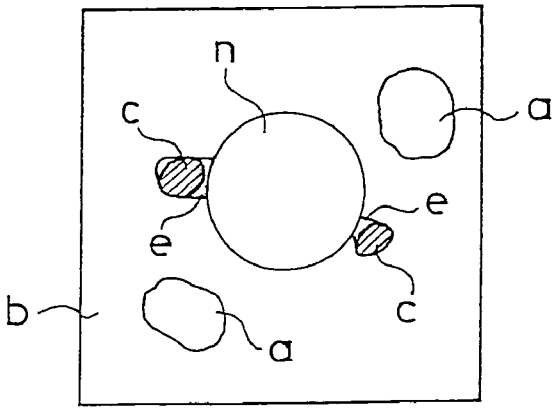

This flotation unit 40 has a plurality of rooms 43 partitioned into partitions 42 in a rectangular tank 41 and is equipped with a stirring machine 44 in each of the rooms 43. This stirring machine 44 has an external pipe 47 outside of a lateral rotary shaft 45. This external pipe 47, as shown in FIG. 6, has an air introducing pipe 48 in the upper part and has a hood 49 to cover a stirring blade 46 in the lower part.

Further, this flotation unit 40 has froth-discharge paths 50 in both sides of the tank 41. This froth-discharge path 50 has an inclined bottom part 51 and a froth gathering path 52 connecting to both of the froth-discharge paths 50 in the valley side. Further, this flotation unit 40 is provided with a froth rake-out machine 54 in the upper part of the side wall (may be referred to as a weir) 53 having the froth-discharge path 50. This froth rake-out machine 54 is configured with a rotary shaft 56 rotated by a motor 55 and a plurality of water wheels 57 provided in this rotary shaft 56.

Further, this flotation unit 40 has a slurry input port 58 on an end face of the upstream side, a tail output port 59 on an end face of the downstream side, and a froth output port 60 in the froth gathering path 52. Further, it has a communication port 61 in each partition 42.

Next, operation of the above-described system is explained by referring to FIGS. 2 to 7.

As shown in FIG. 2, the fly ash a is supplied to the slurry adjusting tank 1 and becomes the slurry d by mixing with the water b. Here, the fly ash concentration in the slurry is adjusted to the range of 5 to 40 wt %, and preferably to the range of 15 to 25 wt %. When the fly ash concentration in the slurry is less than 5 wt %, it is not profitable to industrialize it because the fly ash content is too low. On the other hand, when it exceeds 40 wt %, the slurry concentration becomes high and difficulty occurs in the later steps.

The slurry d in the slurry adjusting tank 1 is supplied to the high speed shear mixer 10 by the pump 3 and the application of the shearing force is performed by the high speed shear mixer 10. The addition of the shear force can be performed using the high speed shear mixer 10 in FIG. 3 for example. A shearing force is applied by the stirring blade 16 rotating at high speed in each room 12 partitioned with a partitioning wall 13, and the slurry d supplied from an input port 19 of the high speed shear mixer 10 is activated. At that time, short passing of the slurry d is prevented by the annular partitioning wall 13 and the shearing force can be applied to the slurry with certainty. The slurry d to which the shearing force is applied, and activated, is discharged from an exit 20 and is supplied to the adjusting tank 30.

As described above, the purpose of applying the shearing force to the slurry of the fly ash and activating it is to improve the floating property of the unburned carbon by performing surface modification. This is explained by referring to FIGS. 7(*a*) to 7(*d*).

The slurry d including the fly ash is, as shown in FIG. 7(*a*), only in the state where the fly ash a and the unburned carbon c are mixed individually in the water b. However, when the shearing force is applied to the slurry d and the surface upgrading of the unburned carbon c is performed, as shown in FIG. 7(*a*), excessive activation energy (surface energy) is generated on the surface of the unburned carbon c, and its surface is lipophiliced (hydrophobiced) even more. On the other hand, the surface of the fly ash a is hydrophiliced more and becomes adaptable to water.

When the collector e and the flother f are added to the slurry after the surface upgrading of the unburned carbon c is performed, as shown in FIG. 7(*c*), the collector e attaches to the unburned carbon c. Then, when the flotation is performed using the flotation unit, as shown in FIG. 7(*d*), the unburned carbon c to which the collector e is attached floats by attaching to air bubbles n.

Moreover, when the shearing force is applied to the slurry by the high speed shear mixer 10, a stirring force (stirring force) of 10 to 100 kWh/m$^3$ per unit slurry amount of the slurry, preferably 30 to 50 kWh/m$^3$ is applied. When the stirring force per unit slurry amount is less than 10 kWh/m$^3$, the surface upgrading of the unburned carbon is insufficient, and when the stirring force per unit slurry amount exceeds 100 kWh/m$^3$, there are problems such as an increase in running cost and wear and tear of the surface upgrading machine.

Further, the residence time of the slurry in the high speed shear mixer 10 is 0.1 to 10 minutes and preferably should be 0.5 to 5 minutes. When the residence time of the slurry is less than 0.1 minute, the surface upgrading of the unburned carbon is insufficient, and when it exceeds 10 minutes, there are problems such as increases in equipment cost and running cost of the surface upgrading machine.

The slurry d' in which the shearing force is applied by the high speed shear mixer 10 and is activated, is supplied to the adjusting tank 30, and in the adjusting tank 30, the collector e (for example, kerosene, gas oil, and heavy oil) and the flother f (for example, MIBC (methylisobutylcarbinol)) are added to the slurry d' after the surface upgrading. When the slurry is stirred at low speed with the stirring blade 31 while the collector e and the flother f are added to the slurry including the lipophiliced unburned carbon, the surface of the unburned carbon c lipophiliced by the activation energy is brought into close contact with the surface of the particles of the collector (refer to FIG. 7(*c*)), and the surface energy decreases. On the other hand, because the surface of the activated fly ash a adapts to water and disperses into water, the surface energy decreases.

Here, the added amount of the collector is 0 to 3.0 wt % and preferably should be 0.05 to 1.0 wt %. Further, the added amount of the flother is 20 to 5,000 ppm and preferably should be 100 to 1000 ppm. When the added amount of the collector exceeds 3.0 wt %, the added amount of the collector becomes excessive and uneconomical.

In the case that the added amount of the flother is less than 20 ppm, the added amount of the flother is insufficient and it becomes difficult to generate air bubbles sufficiently. And, when the added amount of the flother exceeds 5,000 ppm, there is the problem that the recovery rate of the fly ash decreases because fly ash is absorbed into the air bubbles.

Next, the slurry d" that has been stirred and adjusted in the adjusting tank 30 is supplied to the flotation unit 40 by the pump 3. The slurry d' supplied to the flotation unit 40 is stirred with the stirring machine 44. However, air h is sucked in from the air introducing pipe 48 when the stirring machine 44 rotates and the air bubbles n are generated. At that time, it is possible that air may be blown in involuntarily. For example, there is a method in which the air introducing pipe is provided and in which air is supplied from a blower, etc. When the air bubbles are generated, as shown in FIG. 7(*d*), the unburned carbon c is attached to the surface of the air bubbles n through the collector e and floats together with the air bubbles n. The unburned carbon floated together with the air bubbles n is raked out to the outside of the tank by the froth rake-out machine 54 provided on the upper end of the side wall (weir) 53 and flows down to the froth-discharge path 50.

The froth (unburned carbon) i in the froth-discharge path 50 flows along the inclined bottom part 51 and is discharged to the outside of the machine through the froth gathering path 52. Meanwhile, the tail (fly ash) j remaining in the tank 41 is discharged to the outside of the machine from the output port 59 together with water.

In the above explanation, the method whereby the surface of the unburned carbon is modified by the shearing force of the high speed shear mixer is explained. However, the surface of the unburned carbon may be modified by the shearing force using a machine such as an ejector. Any machine may be used essentially as long as it can modify the surface of the unburned carbon by applying a shearing force to the slurry-state unburned carbon.

EMBODIMENTS

Embodiment 1

1000 ml of water and 200 g of fly ash (unburned carbon content, 5.0%) were mixed while being stirred, and were made into slurry. By stirring this slurry at high speed with a high speed shear mixer (high speed shear mixer power: 40 kWh/m$^3$), a shearing force was applied to the slurry, the slurry was activated, and the unburned carbon in the fly ash was lipophiliced (hydrophobiced).

While the slurry that has been lipophiliced by the activation energy was stirred at low speed, 1.3 ml of kerosene as a collector was added and 200 mg of MIBC (methylisobutylcarbinol) as a flother was added. Next, air bubbles were generated by a flotation operation, the unburned carbon was floated by being attached to the generated air bubbles, and the floated air bubbles were taken out as froth. This flotation step was performed continuously for 5 minutes.

Next, when the tail remaining in the container was dried and weighed, it was 165 g, and the amount of the unburned carbon in it was 0.4 wt %. As a result, it was found that the recovery rate of the fly ash was 86.5 wt % (=(165×0.996/200×0.95)×100).

By contrast, in the case when the same amount of kerosene as a collector was added to the slurry before the shearing force was applied with the mixer, as in the conventional method, the recovery rate of the fly ash was 76.5 wt %. Further, the amount of unburned carbon in the recovered fly ash was 1.1 wt %, and it resulted in the amount of the collector being insufficient.

INDUSTRIAL APPLICABILITY

For example, the present invention could possibly be used in removing the unburned carbon effectively from the fly ash generated in a coal burning thermal electric power plant, etc.

What is claimed is:

1. A method for removing unburned carbon from a raw material fly ash comprising the steps of:

(1) adding water to the fly ash to form a slurry;

(2) applying, in the absence of a collector, a shear force to the slurry formed in step (1) with a high speed mixer to lipophilize the unburned carbon by generating activation energy on the surface of the unburned carbon by the shear force; and (3) adding a collector and a frothing agent to the slurry from step (2) whereby the collector attaches to the lipophilized unburned carbon, and performing flotation whereby the unburned carbon attached to the collector attaches to air bubbles formed during flotation and is separated from the fly ash.

2. The method for removing unburned carbon in fly ash as in claim 1, wherein a residence time of the slurry is 0.1 to 10 minutes when the shear force is applying to the fly ash that has been made into a slurry.

* * * * *